US006619915B1

(12) United States Patent
Jorgensen

(10) Patent No.: US 6,619,915 B1
(45) Date of Patent: Sep. 16, 2003

(54) THERMALLY FREE AFT FRAME FOR A TRANSITION DUCT

(75) Inventor: Stephen W. Jorgensen, Stuart, FL (US)

(73) Assignee: Power Systems Mfg, LLC, Jupiter, FL (US)

( * ) Notice: Subject to any disclaimer, the term of this patent is extended or adjusted under 35 U.S.C. 154(b) by 0 days.

(21) Appl. No.: 10/064,675

(22) Filed: Aug. 6, 2002

(51) Int. Cl.[7] ..... F01D 25/26

(52) U.S. Cl. ..... 415/138; 138/109; 138/171; 138/155; 138/DIG. 4; 60/752

(58) Field of Search ..... 415/138; 138/109, 138/171, 155, DIG. 4; 60/752

(56) References Cited

U.S. PATENT DOCUMENTS 6,568,187 B1 * 5/2003 Jorgensen et al. ..... 60/752

* cited by examiner

*Primary Examiner*—Edward K. Look
*Assistant Examiner*—Kimya N. McCoy
(74) *Attorney, Agent, or Firm*—Brian R. Mack

(57) ABSTRACT

A transition duct with a thermally free aft frame for use in a gas turbine engine is disclosed. The transition duct includes an aft frame that is thermally free through the use of a plurality of retention lugs, bushings, and bulkhead assemblies. The aft frame is allowed to adjust from thermal changes as a result of relative sizing between the bushings and retention lugs of the aft frame. An additional feature of this invention is the use of radially extending ribs along the sidewalls of the aft frame, to form an interlocking sealing means with adjacent transition ducts to reduce the amount compressor air leakage into the turbine inlet.

14 Claims, 7 Drawing Sheets

THERMALLY FREE AFT FRAME FOR A TRANSITION DUCT

BACKGROUND OF INVENTION

This invention applies to the combustor section of gas turbine engines used in powerplants to generate electricity. More specifically, this invention relates to the structure that transfers hot combustion gases from a can-annular combustor to the inlet of a turbine.

In a typical can-annular gas turbine engine, a plurality of combustors are arranged in an annular array about the engine. The combustors receive pressurized air from the engine's compressor, add fuel to create a fuel/air mixture, and combust that mixture to produce hot gases. The hot gases exiting the combustors are utilized to turn a turbine, which is coupled to a shaft that drives a generator for generating electricity.

The hot gases are transferred from each combustor to the turbine by a transition duct. Due to the position of the combustors relative to the turbine inlet, the transition duct must change cross-sectional shape from a generally cylindrical shape at the combustor exit to a generally rectangular shape at the turbine inlet. In addition the transition duct undergoes a change in radial position, since the combustors are rigidly mounted radially outboard of the turbine.

The combination of complex geometry changes, rigid mounting means, as well as high operating temperatures seen by the transition duct create a harsh operating environment that can lead to premature deterioration, requiring repair and replacement of the transition ducts. To withstand the hot temperatures from the combustor gases, transition ducts are typically cooled, usually by air, either with internal cooling channels or impingement cooling. Severe cracking has occurred with internally air-cooled transition ducts having certain geometries that are rigidly mounted to the turbine inlet and operate in a high temperature environment. This cracking may be attributable to a variety of factors. Specifically, high steady stresses in the region around the aft end of the transition duct exist where sharp geometry changes occur and a rigid mount is located. Such a rigid mount located at the transition duct aft end does not allow for adequate movement due to thermal growth of the transition duct. In addition stress concentrations have been found that can be attributed to sharp corners where cooling holes intersect the internal cooling channels in the transition duct. Further complicating the high stress conditions are extreme temperature differences between portions of the transition duct.

The present invention seeks to overcome the shortfalls described in the prior art by specifically addressing the high steady stresses attributed to the rigid mounting means, and will now be described with particular reference to the accompanying drawings.

DETAILED DESCRIPTION

Figure 1:
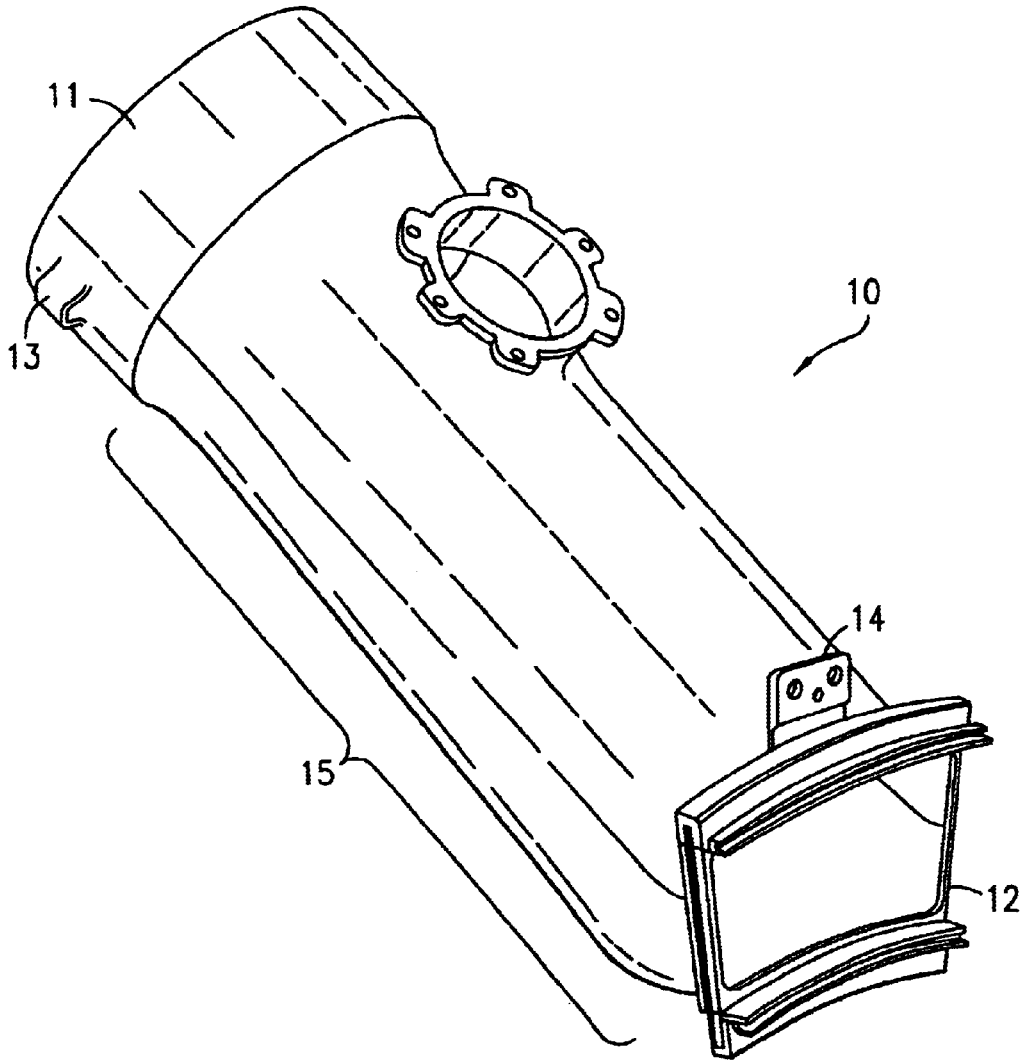
FIG. 1 PRIOR ART
FIG. 1 is a perspective view of a transition duct of the prior art having a rigid mounting system.
Figure 2:
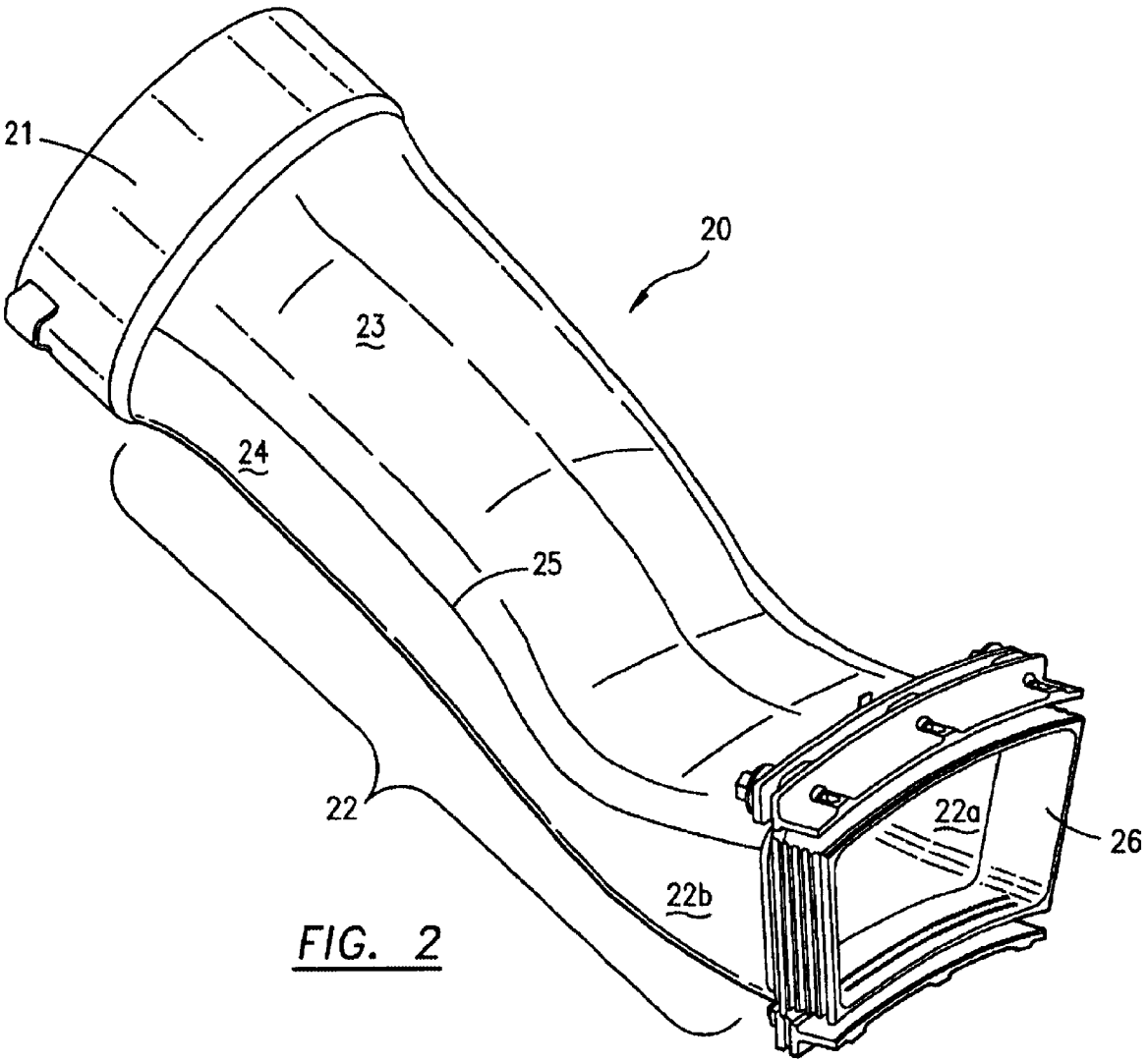
FIG. 2 is a perspective view of a transition duct incorporating the present invention.

Referring to FIG. 1, a transition duct 10 of the prior art is shown in perspective view. The transition duct includes a generally cylindrical inlet sleeve 11 and a generally rectangular exit frame 12. The generally rectangular exit shape is defined by a pair of concentric arcs of different diameters connnected by a pair of radial lines. The can-annular combustor (not shown) engages transition duct 10 at inlet sleeve 11. The hot combustion gases pass through transition duct 10 and pass through exit frame 12 and into the turbine (not shown). Transition duct 10 is mounted to the engine by a forward mounting means 13, fixed to the outside surface of inlet sleeve 11 and mounted to the turbine by an aft mounting means 14, which is fixed to exit frame 12. A panel assembly 15, connects inlet sleeve 11 to exit frame 12 and provides the change in geometric shape for transition duct 10.

Figure 3:
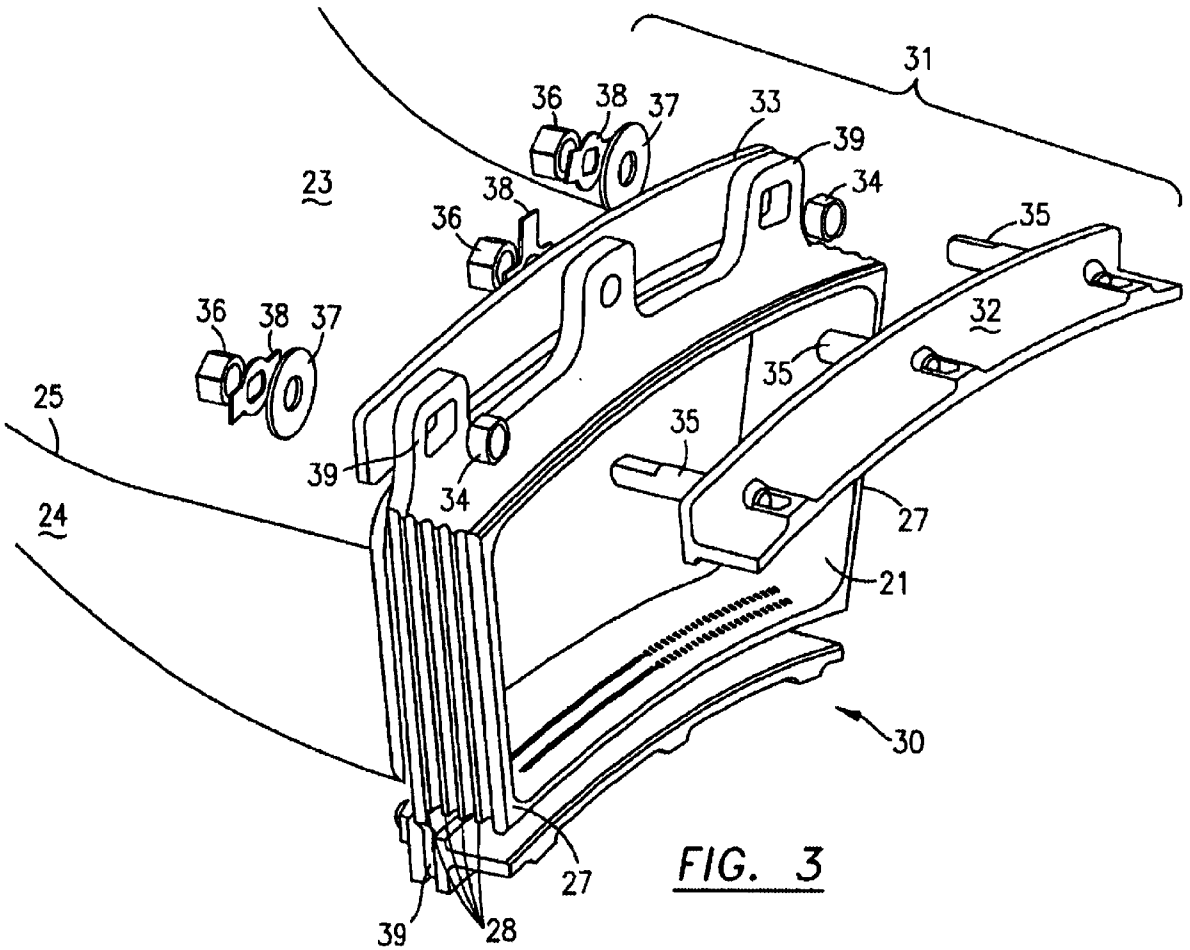
FIG. 3 is a detailed perspective of the present invention.
Figure 4:
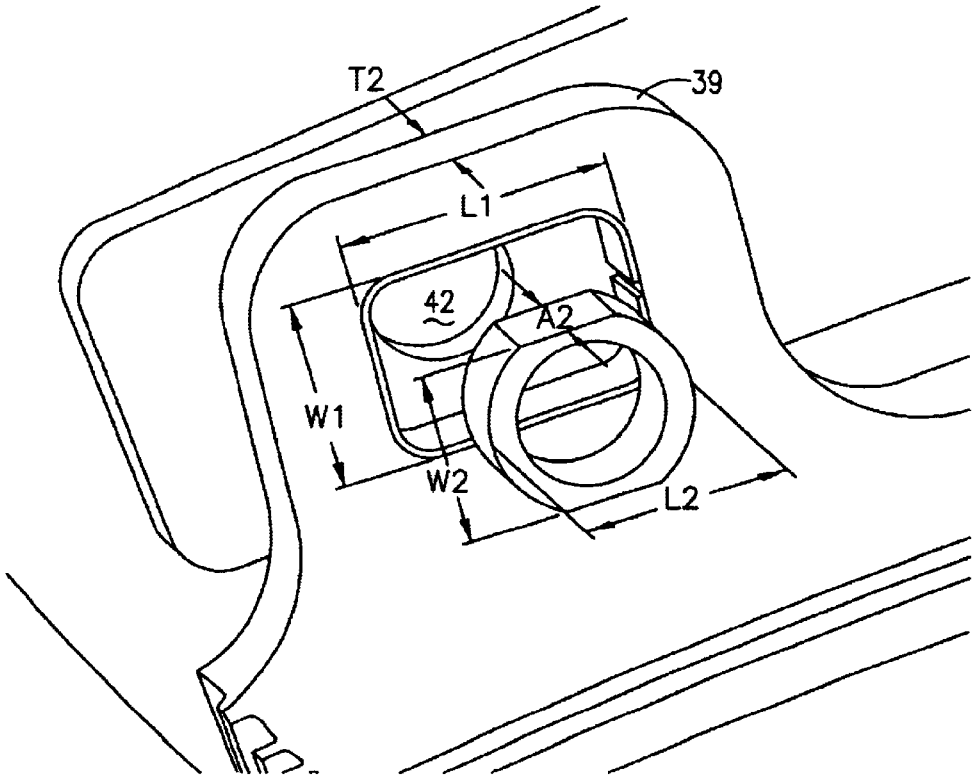
FIG. 4 is a detailed perspective view of a portion of the present invention.
Figure 5:
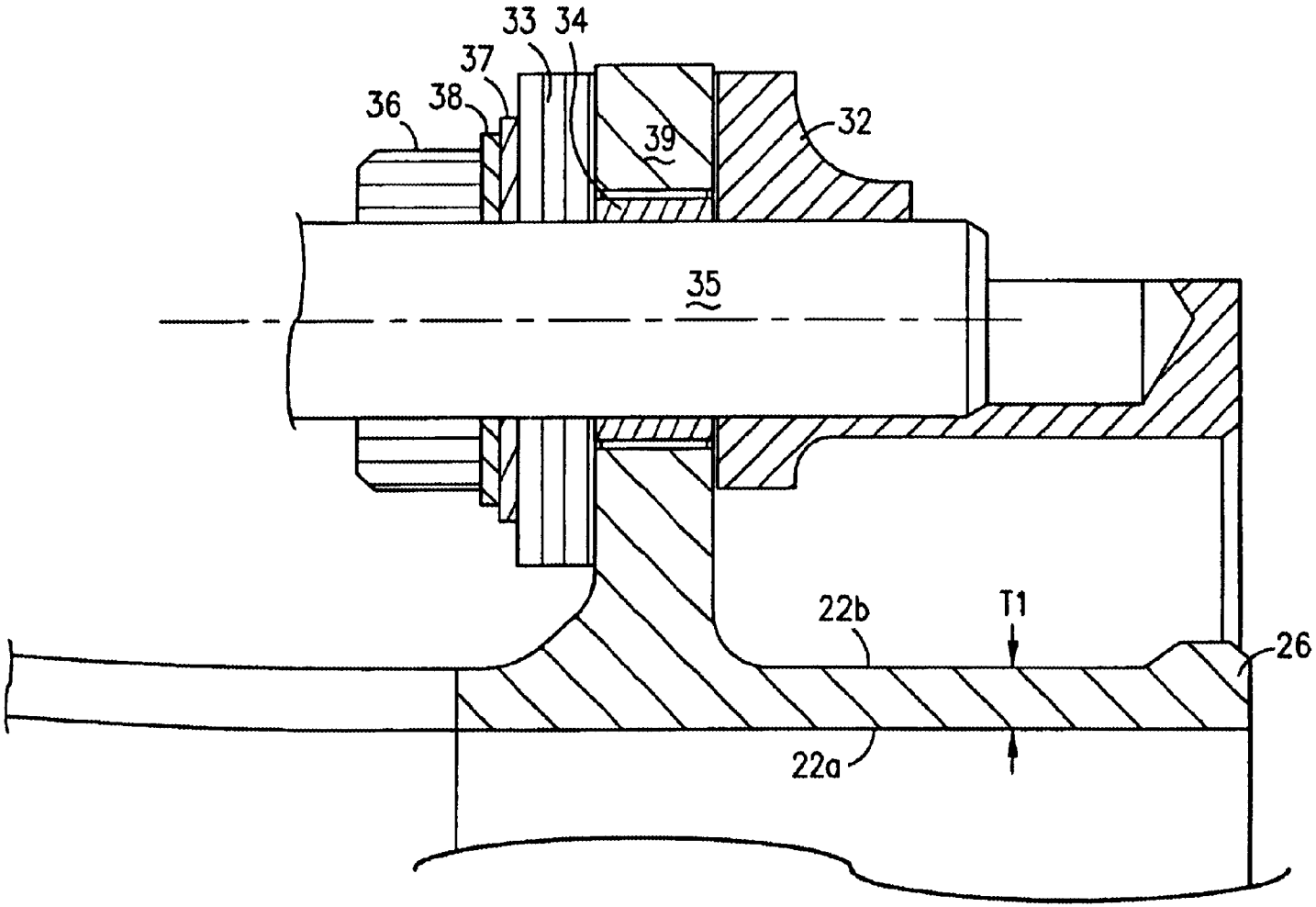
FIG. 5 is a cross section view of a portion of the present invention.

The present invention is shown in detail in FIGS. 2 through 7 and seeks to overcome the shortfalls of the prior art by providing an aft frame region of the transition duct that is free to expand due to thermal changes, hence reducing the operating stresses. The transition duct 20 includes a generally cylindrical inlet sleeve 21 having an inner diameter and outer diameter. Fixed to inlet sleeve 21 is a panel assembly 22 having a first panel 23 and second panel 24, with each panel formed from a single sheet of metal. Panel assembly 22 is formed when first panel 23 is fixed to second panel 24 along a plurality of axial seams 25 by a means such as welding. Once assembled, panel assembly 22 forms a duct having an inner wall 22*a*, an outer wall 22*b*, and a first thickness T1 there between as shown in FIG. 5. Referring back to FIG. 2, panel assembly 22 further contains a generally cylindrical inlet end and a generally rectangular exit end, with the exit end defined by a pair of arcs of different diameters concentric about a center, with the arcs connected by a pair of radial lines extending from the center. Fixed to the rectangular exit end of panel assembly 22 is a generally rectangular aft frame 26 having opposing sidewalls 27 that are generally perpendicular to the arcs of rectangular exit end of panel assembly 22 as shown in FIG. 3. Each of opposing sidewalls 27 have a plurality of radially extending ribs 28 extending outward from sidewalls 27.

Extending from aft frame 26 proximate the arcs of the exit end is a plurality of retention lugs 39 and 40. As shown in FIG. 4, each of retention lugs 39 and 40 have a second thickness T2 and contain a slot having a first circumferential length L1 and a first radial width W1 . Outermost retention lugs 39 are located proximate the ends of the arcs that define the generally rectangular end and each outermost retention lug has a slot that includes a first circumferential length L1 greater than the its first radial width W1.

Fixed to aft frame 26 through retention lugs 39 and 40 are inner and outer bulkhead assemblies 30 and 31. Inner bulkhead assembly 30 and outer bulkhead assembly 31 capture retention lugs 39 and 40 in a manner that allows it to expand under thermal gradients. Inner and outer bulkhead assemblies 30 and 31 are identical in structural components and function and only differ in physical location. For clarity purposes, outer bulkhead assembly 31 will be described in further detail. For example, each bulkhead assembly includes a first and second bulkhead, each having a plurality of first and second holes, respectively. Referring to FIG. 3, outer bulkhead assembly 31 includes a first outer bulkhead 32 having first holes and a second outer bulkhead 33 having second holes. Furthermore, each bulkhead assembly includes a plurality of bushings 34, and as shown in FIG. 4, each bushing having a second axial length A2, a second circumferential length L2, a second radial width W2, and a third through hole.

Bushings 34 are located within each slot of outer retention lugs 39 of aft frame 26 and are preferably pressfit into the slot. Bushings 34 are sized such that first circumferential length L1 of the slot in each of outer retention lugs 39 is greater than second circumferential length L2 of bushing 34, thereby allowing for relative circumferential movement of each of the outermost retention lugs 39, and hence aft frame 26, relative to the bushings received therein. To accommodate relative axial movement due to thermal growth, bushings 34 have a second axial length A2 greater than the second thickness T2 of outer retention lugs 39 as shown in FIG. 5. Due to vibration and movement amongst mating parts, bushings 34 are preferably manufactured from a hardened material such as Haynes 25.

Referring now to FIG. 3, inner and outer bulkhead assemblies 30 and 31, respectively, further include a means for fastening the individual bulkheads and bushings to aft frame 26. In a typical transition duct installation, this is accomplished by a bolt and nut arrangement, 35 and 36, respectively. For example, bolt 35 passes through a first hole in first outer bulkhead 32, through retention lugs 39 and 40, of which outermost retention lugs 39 have bushings 34 pressfit within, through a second hole in second outer bulkhead 33, through washer 37, through lock tab 38, and engage with nut 36. Due to the extreme vibration issues, lock tabs 38 are employed to provide an anti-rotation feature to nuts 36 to prevent disengagement during operation. When inner and outer bulkhead assemblies 30 and 31, respectively, are fully assembled, either the first bulkhead, second bulkhead, or both are slightly offset in spaced relation to retention lugs 39 and 40 due to the greater second axial length A2 of bushing 34 and the second thickness T2 of outer retention lugs 39 and 40, thereby allowing relative movement of the retention lugs and entire aft frame region. This relative axial movement combined with the previously discussed circumferential movement, each of which are due to the retention lug, slot, and bushing dimensions, combine to reduce high stress regions in the transition duct aft frame region compared to rigid mounting mechanisms of the prior art.

Figure 6:
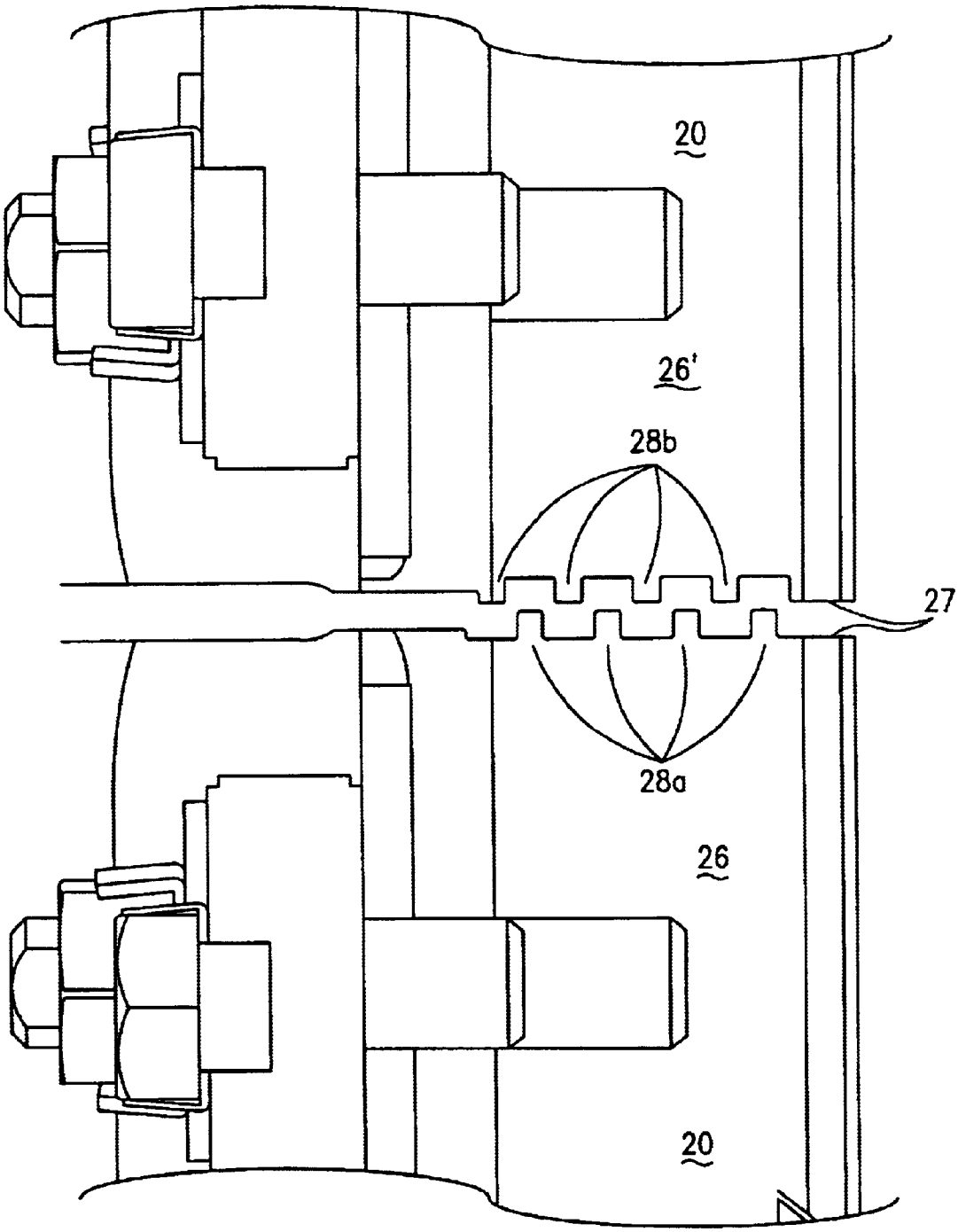
FIG. 6 is a top view of adjacent transition ducts in the installed condition.
Figure 7:
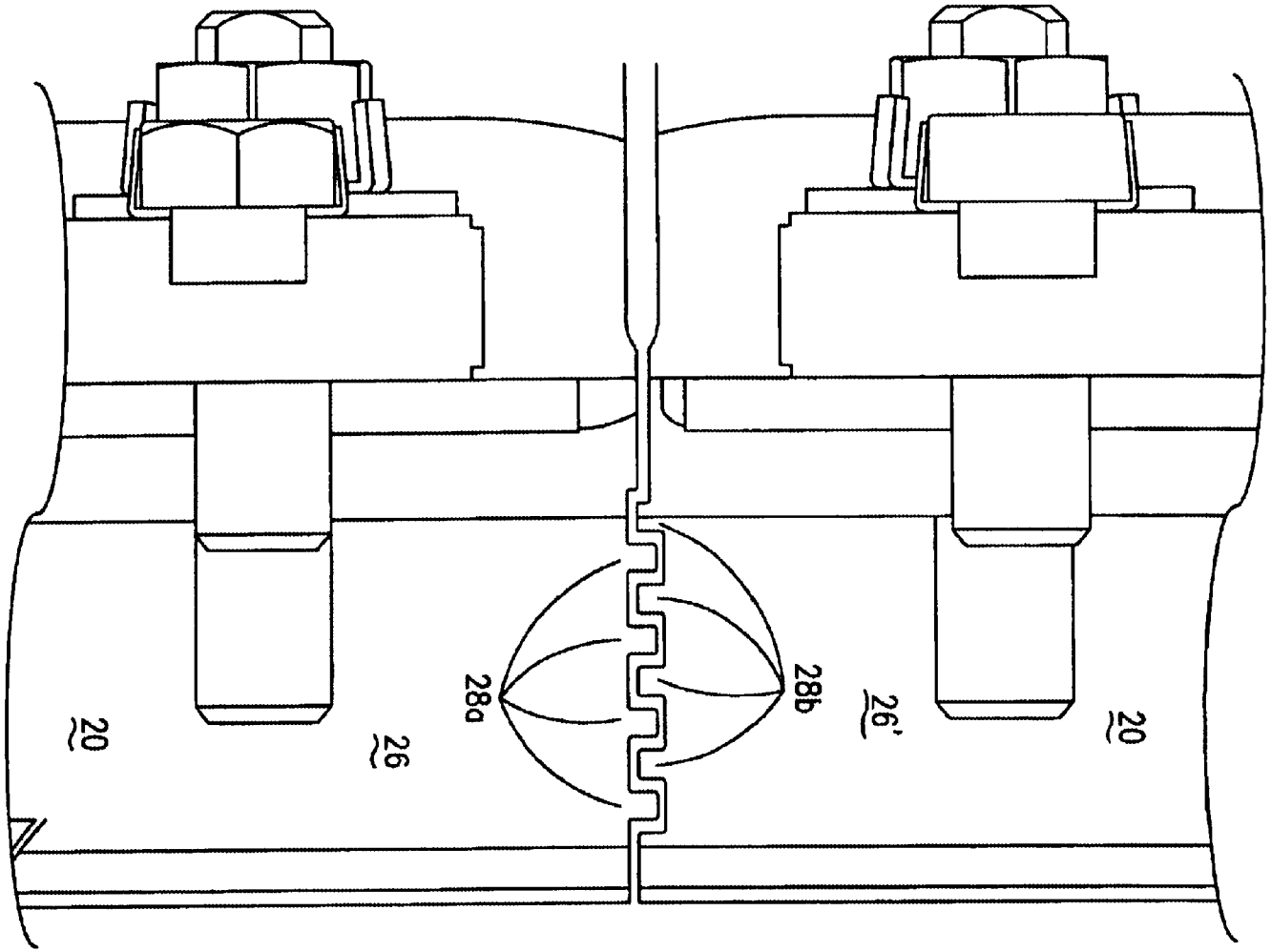
FIG. 7 is a top view of adjacent transition ducts in operation.

An additional feature of the present invention is the plurality of radially extending ribs 28 along opposing sidewalls 27 of aft frame 26 as shown in FIG. 6. Each sidewall 27 includes a plurality of radially extending ribs 28*a* and 28*b*, that are spaced axially along sidewall 27 such that when transition duct 20 is installed in a gas turbine engine, ribs 28*a* of aft frame 26 are interlocking with ribs 28*b* of the frame 26' of an adjacent transition duct 20, as shown in FIG. 6. The transition ducts 20, as positioned during engine operation, are shown in FIG. 7. As the metal temperature of the mating transition ducts rise and the aft frames are allowed to expand circumferentially, due to the thermally free aft frame, this gap decreases and restricts the amount of compressor air leakage into the turbine thereby forming a sealing feature between adjacent transition ducts. Though the adjacent transition ducts end frames 26, 26' do not contact each other to prevent leakage, the amount of compressor air leakage is significantly reduced through the use of a plurality of ribs, typically at least four per end frame. Utilizing ribs 28*a*, 28*b*, as a means for reducing compressor air leakage eliminates the need for additional sealing hardware thereby reducing replacement and repair costs.

While the invention has been described in what is known as presently the preferred embodiment, it is to be understood that the invention is not to be limited to the disclosed embodiment but, on the contrary, is intended to cover various modifications and equivalent arrangements within the scope of the following claims.

I claim:

1. A transition duct for a gas turbine engine comprising:

a panel assembly having:

a first panel formed from a single sheet of metal;

a second panel formed from a single sheet of metal;

said first panel fixed to said second panel along a plurality of axial seams by means such as welding, thereby forming a duct having an inner wall, an outer wall, and a first thickness there between said inner and outer walls, a generally cylindrical inlet end, and a generally rectangular exit end, said generally rectangular exit end defined by a pair of arcs of different diameters concentric about a center and connected by a pair of radial lines extending from said center;

a generally cylindrical inlet sleeve having an inner diameter and outer diameter, said inlet sleeve fixed to said inlet end of said panel assembly;

a generally rectangular aft frame having opposing sidewalls, said frame fixed to said exit end of said panel assembly and having a plurality of radially extending ribs extending outward therefrom along said sidewalls, each of said sidewalls is generally perpendicular to said arcs of said generally rectangular end;

a plurality of retention lugs located on said aft frame proximate said arcs of said generally rectangular exit end; each of said retention lugs having a second thickness and containing a slot having a first circumferential length and a first radial width; the outermost retention lugs located proximate ends of said arcs which define said generally rectangular exit end;

inner and outer bulkhead assemblies including:

a first inner and first outer bulkhead having a plurality of first through holes;

a second inner and second outer bulkhead having a plurality of second through holes;

a plurality of bushings, each bushing having a second axial length, a second circumferential length, a second radial width, and a third through hole;

means for fastening said bulkheads and bushings to said retention lugs of said aft frame such that one of said bushings is located within each of said slots of said outermost retention lugs and said fastening means for each of said bulkhead assemblies passes through said first and second through holes of said first and second bulkheads and through said slot of said retention lugs.

2. The transition duct of claim 1 wherein the second axial length of each of said bushing is greater than the second thickness of each of said retention lugs.

3. The transition duct of claim 1 wherein each of said bushings are pressfit within each of said slots of said outermost retention lugs.

4. The transition duct of claim 1 wherein each of said bushings are fabricated from Haynes 25 material.

5. The transition duct of claim 1 wherein the slots in said outermost retention lugs have a greater first circumferential length than first radial width.

6. The transition duct of claim 1 wherein the first circumferential length of said slot in each of said outer retention lugs is greater than the second circumferential length of said bushing received therein, thereby allowing for relative circumferential movement of each of the outermost retention lugs relative to said bushings received therein.

7. The transition duct of claim 1 wherein said radially extending ribs along said aft frame sidewalls are axially offset to allow interlocking with radially extending ribs of adjacent identical transition duct end frames to form a sealing feature for preventing the leakage of hot combustion gases.

8. The radially extending ribs of claim 7 wherein said sealing feature comprises at least four interlocking ribs along said adjacent sidewalls.

9. A transition duct for a gas turbine engine comprising:

a panel assembly having:

a first panel formed from a single sheet of metal;

a second panel formed from a single sheet of metal;

said first panel fixed to said second panel along a plurality of axial seams by means such as welding, thereby forming a duct having an inner wall, an outer wall, and a first thickness therebetween said inner and outer walls, a generally cylindrical inlet end, and a generally rectangular exit end, said generally rectangular exit end defined by a pair of arcs of different diameters concentric about a center and connected by a pair of radial lines extending from said center;

a generally cylindrical inlet sleeve having an inner diameter and outer diameter, said inlet sleeve fixed to said inlet end of said panel assembly;

a generally rectangular aft frame having opposing sidewalls, said frame fixed to said exit end of said panel assembly;

a plurality of retention lugs located on said aft frame proximate said arcs of said generally rectangular exit end; each of said retention lugs having a second thickness and containing a slot having a first circumferential length and a first radial width; the outermost retention lugs located proximate ends of said arcs which define said generally rectangular exit end;

inner and outer bulkhead assemblies including:

a first inner and first outer bulkhead having a plurality of first through holes;

a second inner and second outer bulkhead having a plurality of second through holes;

a plurality of bushings, each bushing having a second axial length, a second circumferential length, a second radial width, and a third through hole;

means for fastening said bulkheads and bushings to said retention lugs of said aft frame such that one of said bushings is located within each of said slots of said outermost retention lugs and said fastening means for each of said bulkhead assemblies passes through said first and second through holes of said first and second bulkheads and through said slot of said retention lugs.

10. The transition duct of claim 9 wherein the second axial length of each of said bushing is greater than the second thickness of each of said retention lugs.

11. The transition duct of claim 9 wherein each of said bushings are pressfit within each of said slots of said outermost retention lugs.

12. The transition duct of claim 9 wherein each of said bushings are fabricated from Haynes 25 material.

13. The transition duct of claim 9 wherein the slots in said outermost retention lugs have a greater first circumferential length than first radial width.

14. The transition duct of claim 9 wherein the first circumferential length of said slot in each of said outer retention lugs is greater than the second circumferential length of the bushing received therein, thereby allowing for relative circumferential movement of each of the outermost retention lugs relative to said bushings received therein.

* * * * *